United States Patent [19]

Santén et al.

[11] Patent Number: 4,601,786

[45] Date of Patent: Jul. 22, 1986

[54] RECOVERY OF CHEMICALS FROM PULP WASTE LIQUOR WITH PLASMA GENERATOR HEATING

[75] Inventors: Sven Santén, Hofors; Ragnar Bernhard; Sven-Erik Malmeblad, both of Falun, all of Sweden

[73] Assignees: SKF Steel Engineering AB, Hofors; Stora Kopparbergs Bergslags AB, Falun, both of Sweden

[21] Appl. No.: 597,396

[22] Filed: Apr. 6, 1984

[30] Foreign Application Priority Data

Apr. 21, 1983 [SE] Sweden ..... 8302245

[51] Int. Cl.[4] ..... D21C 11/12; D21C 11/00

[52] U.S. Cl. ..... 162/30.1; 162/30.11; 162/31; 423/DIG. 3

[58] Field of Search ..... 162/30.1, 30.11, 31; 422/185; 48/197 R, 209; 252/373; 423/DIG. 3

[56] References Cited

U.S. PATENT DOCUMENTS 2,574,193 11/1951 Savell ..... 162/30.11
3,867,251 2/1975 Holme ..... 162/30.1
4,244,779 1/1981 Nieminen et al. ..... 162/30.1
4,253,911 3/1981 Hillstrom et al. ..... 162/30.1
4,351,252 9/1982 Shindome et al. ..... 110/346

FOREIGN PATENT DOCUMENTS

WO/00509 2/1982 PCT Int'l Appl. .
1535953 12/1978 United Kingdom .

*Primary Examiner*—S. Leon Bashore
*Assistant Examiner*—K. M. Hastings
*Attorney, Agent, or Firm*—Armstrong, Nikaido, Marmelstein & Kubovcik

[57] ABSTRACT

The invention relates to the recovery of chemicals from waste liquor from wood pulp process, primarily black liquor, while utilizing energy liberated. Controlled total vaporization of the pulp waste liquor at high temperature and low oxygen potential is achieved by the external supply of energy. During the subsequent condensation and separation a melt or water solution is obtained which, without causticizing, can be used for the preparation of white liquor, and also an energy rich gas and mainly free from sulphur, consisting primarily of carbon monoxide and hydrogen.

8 Claims, 3 Drawing Figures

RECOVERY OF CHEMICALS FROM PULP WASTE LIQUOR WITH PLASMA GENERATOR HEATING

Figure 1:
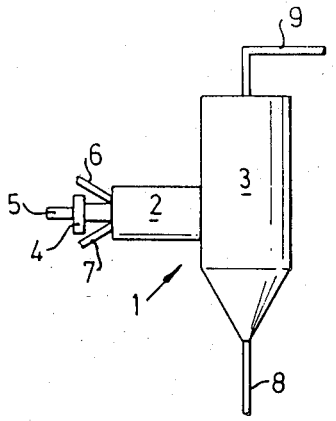

The present invention relates to a method of recovering chemicals from waste liquor from wood pulp production, primarily from the kraft process simultanously utilizing energy liberated during the process, and to a means for carrying out the method.

As is known, in the pulp industry chemicals must be recovered to the greatest possible extent, both from the cost and the environmental points of view. In principle such recovery processes comprise three stages, a sulphur reducing process, a process for separating out inorganic products and a process for oxidation of the organic content with the generation of energy. These processes can be carried out as separate processes or in a single process unit. Today's recovery boiler, known as the Tomlinson boiler, is of the latter type and its prime drawback is that none of the three process stages can be optimized independently of the others.

There has been intensive research in this field over a considerable period, in order to achieve new technical solutions. However, the recovery boiler has so far been found to be superior although calculations based on chemical and thermodynamic relations indicate that an ideal chemical recovering process "is not really possible in view of the chemical, thermodynamic and energy-related limitations prevailing", see the article entitled "Possible alternatives for the recovery of chemicals from the sulphate process", H. Magnusson and B. Warnqvist, published in Kemisk Tidskrift No, 12, 1982.

The chemical recovery is intimately associated with the recovery of energy from the pulp waste liquor. There is always a risk of melt-water explosions in the recovery boiler, since the melt is in contact with water-filled steam-generating tubes in the recovery boiler. For safety reasons, therefore, the steam pressure used must be limited.

The object of the present invention is to achieve a process which eliminates the above drawbacks and enables individual optimization of the unit operations as well as enabling the recovery of chemicals in a form which can be used without further conversion.

Another object of the invention is to achieve a means for performing the method according to the invention, the said means replacing the previously used recovery boiler and also eliminating the need for causticizing units and lime kilns.

This is achieved by the method proposed according to the present invention, primarily in that the pulp waste liquor is fed into the reaction zone of a reactor with the simultaneous supply of external thermal energy, independent from the combustion, the temperature and oxygen potential being individually carefully controlled by means of regulated supply of said thermal energy and possibly the addition of carbonaceous material and/or gas containing oxygen, that the product obtained is cooled or allowed to cool in a cooling zone arranged in said reactor, that the inorganic constituents are withdrawn in the form of a melt or water solution and that the organic portion is withdrawn in the form of a gas, comprising primarily hydrogen and carbon monoxide.

The external supply of energy to the reaction zone of the reactor produces a high temperature at low oxygen potential and the sodium content is thus obtained mainly in the form of a monatomic gas. By means of the carefully regulated oxygen potential and temperature, preferably achieved by the use of a gas rich in energy and heated in a plasma generator for the supply of external thermal energy, sodium hydroxide and sodium sulphide, i.e. white liquor chemicals, are the main constituents obtained upon cooling, at the same time that the formation of sodium carbonate is inhibited.

Furthermore, controlling the temperature produces a valuable gas comprising almost only hydrogen and carbon-monoxide, which can thus be used for steam generation, as synthesis gas, etc.

The solution proposed according to the invention therefore surprisingly eliminates all risk of melt-water explosions which, as described above, is an extremely serious problem with conventional methods, as well as enabling accurate control of the entire process.

Since the risk of melt-water explosion is eliminated, the steam pressure can be increased during steam generation and a greater proportion of thermal energy can thus be recovered as electric energy in a turbine.

The means for carrying out the method proposed in accordance with the invention is mainly characterised by a reactor containing a reaction zone and a cooling zone with supply conduits for pulp waste liquor as well as conduits for the possible supply of additional material such as carbonaceous material, gas containing oxygen, etc., as well as a source of external heat, the cooling zone being provided with a lower outlet for the withdrawal of inorganic constituents in the form of a melt or water solution and an upper gas outlet for the withdrawal of gas generated.

According to a preferred embodiment a plasma generator is used as the external source of thermal energy.

Figure 2:
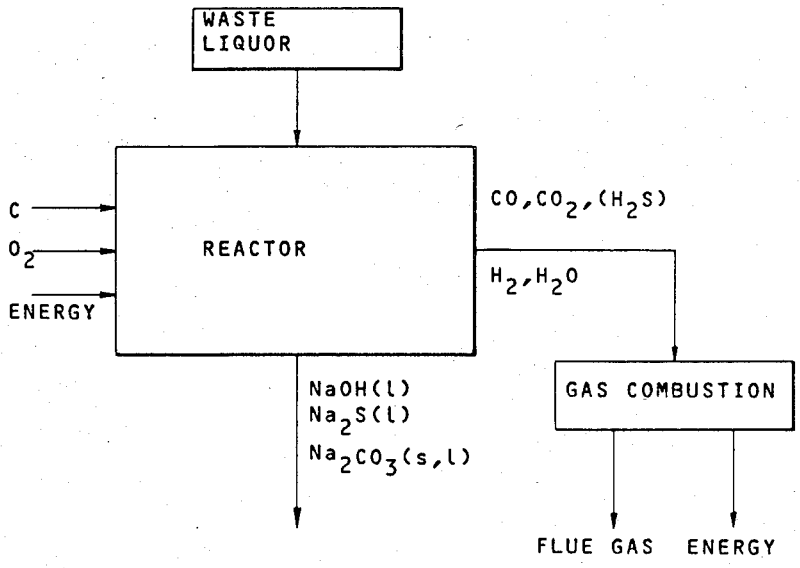
Figure 3:
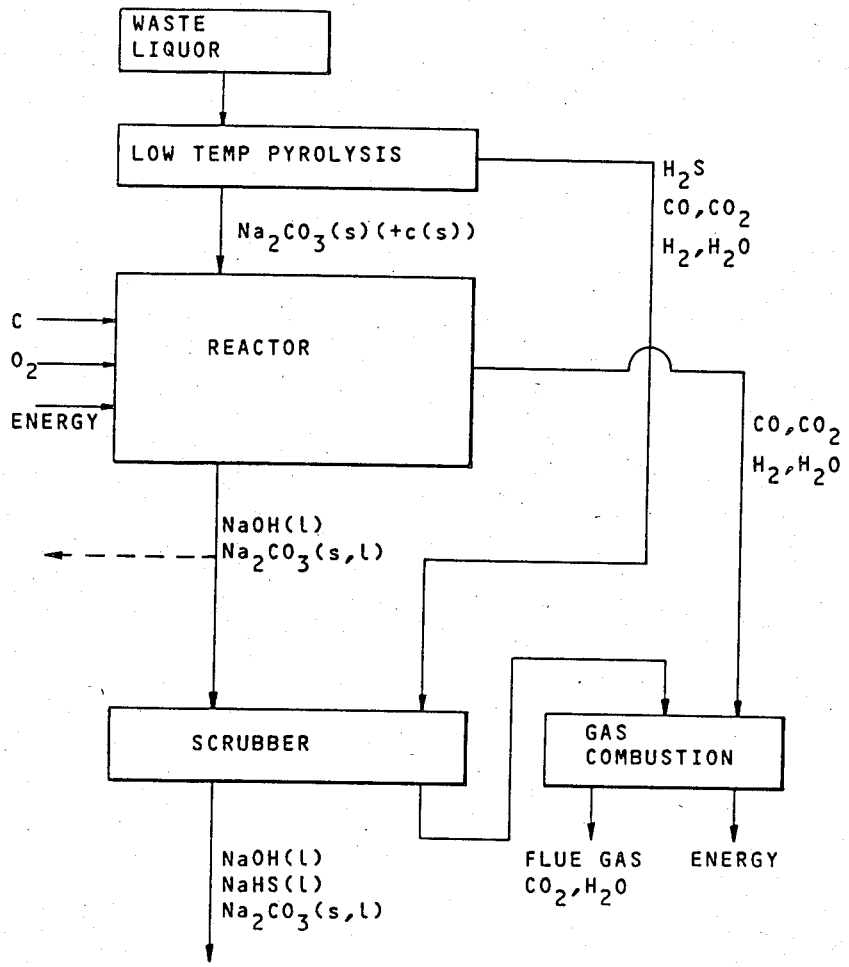

Further characteristics and advantages of the present invention will be clear from the following detailed description in conjunction with a number of examples illustrating the invention and with reference to the accompanying drawings in which FIG. 1 shows schematically a means suitable for carrying out the process according to the invention, FIG. 2 shows in principle a simplified process flow sheet for the recovery of chemicals from black liquor, and FIG. 3 shows a modification of the process flow sheet shown in FIG. 2.

The invention will be described primarily with respect to recovering chemicals from waste liquor from the kraft cellulose process, but can also be used with advantage for regenerating other types of waste liquor.

The black liquor normally has a dry substance content (DS) of approximately 15%. In general the liquor is evaporated before entering the recovery boiler and the DS is then 60–65%, the product being termed thereafter "thick liquor". The black liquor contains primarily sodium, sulphur, carbonate and lignin compounds. In the recovery boiler the sodium content gives a melt containing primarily carbonate and sulphide. Part of the sulphur content leaves in gas form.

The melt from the recovery boiler is tapped off and dissolved to give a "green liquor" which is then converted with quicklime in a causticizing plant, according to the following reaction:

$$Ca(OH)_2 + Na_2CO_3 = 2\ NaOH + CaCO_3$$

The sodium sulphide is not affected. Most of the calcium carbonate is removed in the form of a slurry, known as lime mud in a clarifier. The remaining solution then consists of sodium hydroxide, sodium carbonate and sodium sulphide, i.e. white liquor, which is returned to the digester house.

The lime mud separated off is in most cases burned in a lime kiln consisting of a cylindrical rotary kiln. The product from the kiln is quicklime which is then returned to the causticizing plant.

As has already been stated, one of the objects of the invention is to eliminate both the causticizing unit and the lime kiln. The process according to the invention is suitably performed in an arrangement of the type shown schematically in FIG. 1, comprising a reactor 1 with reaction zone 2 and cooling zone 3. Partial vaporization and disintegration is carried out in the reaction zone, with the supply of external thermal energy independent from the combustion, preferably supplied by means of a gas rich in energy and heated by a plasma generator 4. The gas to be heated is supplied through a conduit 5.

The energy supply is controlled so that the temperature in the combustion chamber is maintained at 1000°-1300° C. The waste liquor is supplied through inlet pipe 6 immediately above the plasma generator 4. Additional supply inlets 7 are provided for carbonaceous material and/or gas containing oxygen to regulate oxygen potential and temperature in the reaction zone and also to control the partial pressure of carbon dioxide.

The use of the plasma generator for the supply of external energy enables total vaporization of the liquor. Sodium is thus to approximately 99% present in the form of a monatomic gas in the equilibrium mixture obtained.

From the reaction zone, the product obtained passes to the cooling zone 3 where the temperature is kept between 600° and 900° C. A number of condensed sodium compounds are thus formed, the following reactions competing:

$$2Na + 2H_2O = 2NaOH + H_2 \quad (1)$$

$$2NaOH + CO_2 = Na_2CO_3 + H_2O \quad (2)$$

$$2NaOH + H_2S = Na_2S + 2\,H_2O \quad (3)$$

By controlling the partial pressure ratios $H_2/H_2O$ and $CO/CO_2$ the reactions can be controlled to minimize the sodium carbonate content in the melt.

Melt containing sodium hydroxide, sodium sulphide and a small quantity of sodium carbonate is withdrawn from the cooling zone 3 through an outlet 8. Depending on the cooling, the inorganic product obtained can also be withdrawn in the form of a water solution, in which case the sulphide is in the form of sodium hydrosulphide.

The energy-rich gas, comprising primarily hydrogen and carbon monoxide is withdrawn through a gas outlet 9 to be used for energy generation in a steam boiler, for instance, or as synthesis gas, etc. If the gas is used in a steam boiler the advantage over the recovery boiler process is that the melt never comes into direct contact with the tubes and the pressure in the tubes can be chosen regardless of any risk of melt-water explosion.

FIG. 2 shows schematically a process flow sheet for a chemical regeneration cycle according to the invention, designed for regenerating black liquor. The black liquor, preferably in the form of thick liquor, is supplied to a plasma reactor of the type shown in FIG. 1. The material fed will thus be completely vaporized and partially disintegrated. External energy besides the liberated thermal energy is thus supplied by transferring electrical energy from an electric arc to a suitable gas passing through the arc, the gas thereby acquiring an extremely high energy concentration.

Examples of suitable gases are water vapour and air. If air is used, however, the risk of nitrogen oxide being formed should be observed.

As the sodium content is normally solely in the form of a monatomic gas, the composition of the resultant product can be controlled accurately. In the cooling zone hydrogen sulphide is absorbed in the melt and the sulphur content in the gas leaving will therefore be low, while the melt will contain sodium hydroxide and sodium sulphide and only a small quantity of sodium carbonate.

After the plasma reactor a dissolving and recrystallization stage may be included to further reduce the sodium carbonate content in the product leaving. It should be noted here that the product obtained after conventional causticizing contains approximately 25% sodium carbonate, which is considered quite acceptable in a white liquor. According to the invention, the product after the plasma reactor stage normally contains approximately 10% sodium carbonate.

FIG. 3 shows a modification of the process flow sheet according to FIG. 2. The pulp waste liquor is here subject in a first stage to a low temperature pyrolysis, after which the sodium contained therein will be in the form of sodium carbonate. This product, possibly together with reduced solid carbon, is then supplied to the plasma reactor. The gas formed during the low temperature pyrolysis will have a relatively high sulphur content, primarily in the form of hydrogen sulphide.

This pyrolysis stage reduces the energy requirement in the plasma reactor and at the same time an extremely pure product is obtained from the plasma reactor stage which, apart from a small quantity of carbonate, contains substantially pure sodium hydroxide. This means that—if there is an excess on the digester chemical side—sodium hydroxide can be withdrawn directly for use in the bleaching plant, for instance.

The melt from the plasma reactor is then transferred to a scrubber where it is converted by the gas formed in the pyrolysis stage, to form a water solution containing sodium hydroxide, sodium hydrosulphide and sodium carbonate, i.e. white liquor.

The gas formed in the plasma reactor and the gas washed in the scrubber are then fed to gas combustion.

If sodium sulphite and sodium bisulphite are desired as a product, the scrubbing can be performed after combustion, i.e. after hydrogen sulphide has been combusted to sulphur dioxide.

Sodium chloride from wood and liquor can be enriched to a dangerous level in the chemical cycle of a pulp mill. Since sodium chloride has a relatively low solubility in concentrated sodium hydroxide solution, the modified process enables sodium chloride to be purged out by partial evaporation of the sodium hydroxide obtained, for instance.

In the following samples of two pilot experiments are given to further illustrate the invention.

EXAMPLE 1

The pulp waste liquor used in the experiment had a DS of 67% with the following elemental analysis:

C: 35%
H: 4%
Na: 19%
S: 5%
O: 37%

1800 kWh per ton DS was supplied via the plasma generator as external thermal energy, thus producing total vaporization. The temperature in the reaction zone was maintained at approximately 1200° C. and the temperature in the cooling zone in the plasma reactor was kept at approximately 800° C., whereupon the inorganic matter was separated out in liquid form. A reaction occurred in the cooling zone between the hydrogen sulphide formed and the melt, giving an extremely low sulphur content in the gas leaving. The gas leaving, converted to normal pressure and temperature conditions, comprised the following calculated per ton thick liquor DS:

$CO_2$: 90 $m^3$
CO: 558 $m^3$
$H_2O$: 333 $m^3$
$H_2$: 680 $m^3$
$H_2S$: 0.3 $m^3$
Na(g): 0.2 $m^3$

Calculated per ton thick liquor DS, the melt obtained contained:

$Na_2CO_3$: 44 kg
NaOH: 172 kg
$Na_2S$: 120 kg

The melt obtained thus contained only about 13% sodium carbonate which should be compared with the product obtained after conventional causticizing which contains about 25% sodium carbonate. The product obtained can thus be used directly for preparing white liquor without the causticizing and lime kiln stages.

EXAMPLE II

In this experiment a thick liquor of the type used in Example 1 was first subjected to pyrolysis at a temperature of between 650° and 750° C., to obtain a gas containing hydrogen sulphide, carbon monoxide, carbon dioxide, hydrogen and water vapour and a partially molten phase consisting primarily of sodium carbonate and solid carbon. The energy supply was provided by the addition of sufficient air to produce partial combustion.

The sodium carbonate-carbon mixture obtained was fed into the plasma reactor, a temperature of 1200° C. being maintained in the reaction zone. In this case only about half the amount of energy required when the thick liquor was fed directly into the plasma generator as shown in Example 1 was needed.

Calculated per kmol $Na_2CO_3$, 150 kWh electric power was supplied to the plasma generator, 2.8 kmol C and 2 kmol $H_2O$. A melt was obtained containing 0.1 kmol $Na_2CO_3$ and 1.8 kmol NaOH, and a gas containing 3.0 kmol CO, 0.7 kmol $CO_2$, 1.0 kmol $H_2$ and 0.7 kmol $H_2O$.

The melt can then be converted using the gas obtained from the pyrolysis stage, to form white liquor chemicals and a gas almost free from sulphur. Alternatively, the melt obtained from the plasma reactor stage after dissolving, can be used directly in other processes, e.g. as bleaching chemical. In principle, therefore, this process can be considered as an alternative to the conventional electrolytic method of manufacturing sodium hydroxide, the electrolysis method necessarily producing chlorine gas as a by-product.

As is clear from the above, the process according to the invention has many advantages. Since the gas produced has an extremely low sulphur content, or none at all, there will be negligible amounts of sulphur dioxide upon combustion. This eliminates the need for expensive purifying equipment. Since causticizing is rendered superfluous, impurities are not introduced in the form of aluminium or silicon, for instance, which are otherwise obtained from the calcium added, which may be 20 kg calcium per ton of pulp in a conventional causticizing plant. The elimination of both the lime kiln and causticizing stages according to the invention, results in considerable savings in energy consumption, investment and maintenance.

We claim:

1. The method of recovering chemicals from waste liquor of wood pulp production, comprising in combination:

(a) feeding a pulp waster liquor of organic and inorganic constituents into a reaction zone of a reactor;
(b) heating the pulp waste liquor by means of a plasma generator which can raise the temperature of the reaction zone independently of the oxidation level in the reaction zone such that the pulp waste liquor is substantially completely vaporized and converted to a product mixture consisting essentially of sodium sulfide, sodium hydroxide, monatomic sodium, hydrogen, and carbon monoxide;
(c) cooling the product mixture in a cooling zone of the reactor;
(d) withdrawing the inorganic constituents of the pulp waste liquor as a white liquor melt or solution; and
(e) withdrawing the organic constituents as a combustible synthesis gas of hydrogen and carbon monoxide such that the organic constituents can be used to power a separate steam generator.

2. Method according to claim 1, characterised by that a temperature of 1000°–1300° C. is maintained in the reaction zone.

3. Method according to claim 1, characterised by that the temperature in the cooling zone is maintained at approximately 600°–900° C.

4. Method according to claim 1, which includes the initial step of subjecting said waste liquor to low temperature pyrolysis to produce a gas and sodium carbonate-carbon mixture and feeding said mixture to said reaction zone.

5. Method according to claim 4, in which the temperature in the pyrolysis stage is maintained at approximately 600°–800° C.

6. Method according to claim 4, in which a gas containing oxygen is supplied during the pyrolysis stage.

7. Method according to claim 4, wherein energy is supplied during the pyrolysis stage by means of a plasma generator.

8. Method according to claim 4, wherein the gas formed during the pyrolysis is reacted with said melt, to form said white liquor chemicals and a sulphur-free gas.

* * * * *